United States Patent [19]

Mayer et al.

[11] 4,294,086

[45] Oct. 13, 1981

[54] LATCH NEEDLE FOR KNITTING MACHINES

[75] Inventors: Harald Mayer; Hardo Berentzen, both of Albstadt, Fed. Rep. of Germany

[73] Assignee: Theodor Groz & Sohne & Ernst Beckert Nadelfabrik Commandit-Gesellschaft, Albstadt, Fed. Rep. of Germany

[21] Appl. No.: 887,587

[22] Filed: Mar. 17, 1978

[30] Foreign Application Priority Data

Apr. 1, 1977 [DE] Fed. Rep. of Germany ..... 2714607

[51] Int. Cl.[3] ..... D04B 35/04

[52] U.S. Cl. ..... 66/121

[58] Field of Search ..... 66/121, 122

[56] References Cited

U.S. PATENT DOCUMENTS

| | | | |
|---|---|---|---|
| 400,330 | 3/1889 | Goodman | 66/121 |
| 938,795 | 11/1909 | Scott | 66/122 X |
| 1,168,039 | 1/1916 | Swinglehurst | 66/121 |
| 1,759,363 | 5/1930 | Parlini | 66/121 X |
| 1,764,342 | 6/1930 | Parlini | 66/121 |
| 1,824,445 | 9/1931 | Parlini | 66/121 |
| 2,249,780 | 7/1941 | Page | 66/121 |
| 3,031,867 | 5/1962 | Wiederhut et al. | 66/121 |
| 3,164,000 | 1/1965 | Ashe | 66/121 |

FOREIGN PATENT DOCUMENTS

| | | | |
|---|---|---|---|
| 586678 | 10/1933 | Fed. Rep. of Germany | 66/121 |

*Primary Examiner*—Werner H. Schroeder
*Assistant Examiner*—Andrew M. Falik
*Attorney, Agent, or Firm*—Allison C. Collard; Thomas M. Galgano

[57] ABSTRACT

A latch needle for knitting machines has a hook and needle shank and a latch pivotally mounted in a longitudinal slot in the needle shank with the faces of the needle shank flanking the longitudinal slot having support portions recessed relative to the upper edge of the needle shank for supporting a widened portion of the rear part or spine of the latch. A short portion of the longitudinal slot contains an aperture leading to the lower edge of the needle shank, and a further portion of the longitudinal slot adjacent to the short portion is deeper than half the height of the needle shank and projects in length beyond the end of the latch in its rearward open position displaced away from the hook. The support portions of the shank for the widened portion of the spine of the latch are located over the inner starting region of the further portion of the longitudinal slot.

1 Claim, 3 Drawing Figures

I-I

LATCH NEEDLE FOR KNITTING MACHINES

BACKGROUND OF THE INVENTION

The present invention relates to a latch needle for knitting machines or the like having a latch pivotally mounted in a longitudinally extending slot of the needle shaft or shank and a support flanking the longitudinal slot and being recessed relative to the upper edge of the needle shank for supporting an enlarged spine portion of the latch flanking the shank faces thereof. Said support is obtained by an impression or milled recess and is adapted as closely as possible in its rearward position to the abutment of the enlarged spine portion of the latch in order to absorb the impact forces occurring.

The object of the invention is to counteract the increased material stresses in latch and needle shank during the impacting of the latch in the outer rearward position against the support portions of the needle shank which impacts are constantly occurring during knitting operations performed at ever increasing speed.

SUMMARY OF THE INVENTION

According to the present invention there is provided a latch needle for knitting machines having a hook and needle shank and a latch pivotally mounted in a longitudinal slot in the needle shaft or shank with the faces of the needle shank flanking the longitudinal slot having support portions recessed relative the upper edge of the needle shank for supporting a widened portion of the rear part or spine of the latch. A short portion of the longitudinal slot contains an aperture leading to the lower edge of the needle shank, and a further portion of the longitudinal slot adjacent said short portion defines a channel characterized by an initial substantially rectilinear base wall and a further curved base wall which merges with the upper edge of the needle shank. The supporting portion of the needle shank for the widened, rounded portion of the spine of the latch is located over the substantially rectilinear base wall region of the further portion. The channel of the further portion is deeper than half the height of the needle shank in the substantially rectilinear base wall region and it projects in length beyond the end of the latch when in its rearward open position displaced away from its associated hook.

In accordance with the invention the support surfaces are located on the faces of the needle shank which flank the longitudinal slot and due to the new configuration said flanking portions become resilient and they hence resiliently absorb the impact forces during impact of the widened spine portion of the latch against the support surfaces so that both the latch and the needle shaft are preserved. The said elasticity or resilience absorbs the impact forces and prevents the occurrence of excessive material stresses on the needle shank parts and in the latch. In order for the mounting of the latch not to be impaired by the said resilient configuration which is especially necessary when the bearing pin consists of flaps formed from the faces of the needle shank, and hence is divided, the portion of the longitudinal slot containing the aperture to the lower edge of the needle shaft inevitable for the discharge of slubbing is short relative to other portions of the longitudinal slot.

BRIEF DESCRIPTION OF THE DRAWING

The invention will be described further, by way of example, with reference to the accompanying drawings, in which.

DESCRIPTION OF THE PREFERRED AND ILLUSTRATED EMBODIMENT

Figure 1:
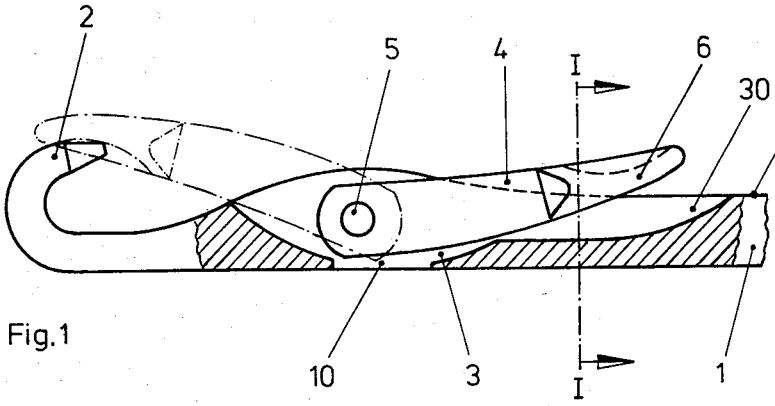
FIG. 1 is a partial side view and a fragmentary section of a latch needle.
Figure 3:
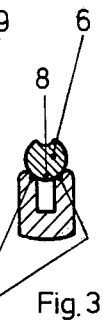
FIG. 3 is a cross-sectional view taken on the line III—III of FIG. 1.
Figure 2:
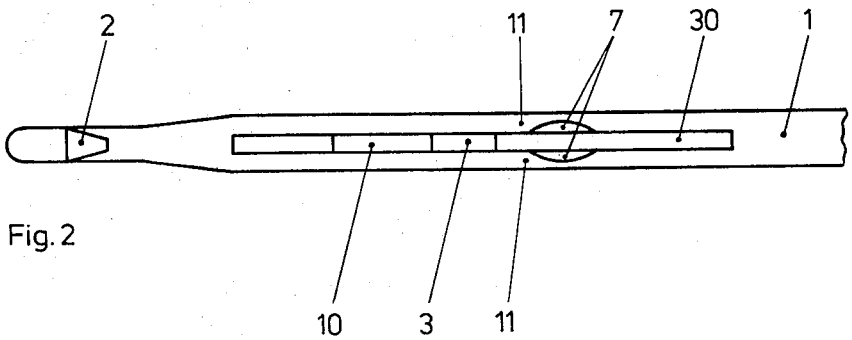
FIG. 2 is a plan view of the needle of FIG. 1 without latch.

A latch needle is shown comprising a shank or shaft 1 having one or both ends bent into a hook 2. The needle shaft or shank 1 has a longitudinal slot 3 in which a needle latch 4 is pivotally mounted on a pivotal axle 5. The shank of the latch 4 terminates in a latch tip or head 6 which is so widened and shaped that in one end position of its pivotal movement executed during the knitting operation and as shown in chain-dotted line in FIG. 1, it abuts against the hook 2. In its other end position (rearward position), the latch tip or head 6 is supported with the rounded, wedge-like widened portion 8 of the spine against a support portion 7 of the needle shank. Support portion 7 is recessed relative to the upper edge 9 of the needle shaft so as to permit the thread to slip under the end of the latch.

The longitudinal slot 3 has an aperture 10 below the pivotal axis 5 and through which aperture slubbings may be discharged. The portion 3 of the longitudinal slot is as short as possible and is adjoined by a further portion 30 of the longitudinal slot which, in its supporting section, extends deeper than half the height of the needle shank 1, and which further portion projects in length beyond the end of the latch when located in its rearward position. As a result of the lengthening of the slot, the faces 11 of the shaft flanking the longitudinal slot 30 are relatively resilient and latch support portions 7 carried thereby may, as a result thereof, absorb and dampen the impact forces of the latch during impact of the latch against the support portion 7.

We claim:

1. A latch needle for knitting or like machines comprising:

an elongated needle shank having an upper edge and a lower edge, and a hook at at least one end thereof and a longitudinally-extending slot formed therein flanked by a pair of opposed faces, and a latch pivotably mounted in said slot and having a spine with a widened wedge-like, rounded portion, said needle shank having a supporting portion for the widened, rounded portion of the spine of the latch at the faces of said shank flanking said longitudinal slot and said supporting portion being recessed relative to the upper edge of said needle shank, said longitudinal slot having a short recessed portion defined by a curved base wall containing an aperture leading to the lower edge of said needle shank and a further portion adjacent to said short portion which defines a channel characterized by an initial substantially rectilinear base wall and a further curved base wall which merges with said upper edge of the needle shank, said supporting portion of said needle shank for said widened, rounded portion of the spine of the latch being located over the substantially rectilinear base wall region of said further portion and said channel of said further portion being deeper than half the height of said needle shank in said substantially rectilinear base wall region and projecting in length beyond the end of said latch when in its rearward open position displaced away from its associated hook.

* * * * *

REEXAMINATION CERTIFICATE (355th)

United States Patent [19]

Mayer et al.

[11] B1 4,294,086

[45] Certificate Issued May 28, 1985

[54] LATCH NEEDLE FOR KNITTING MACHINES

[75] Inventors: Harald Mayer; Hardo Berentzen, both of Albstadt, Fed. Rep. of Germany

[73] Assignee: Theodor Groz & Sohne & Ernst Beckert Nadelfabrik Commandit-Gesellschaft, Albstadt, Fed. Rep. of Germany

Reexamination Request:
No. 90/000,556, May 18, 1984

Reexamination Certificate for:

| | |
|---|---|
| Patent No.: | **4,294,086** |
| Issued: | **Oct. 13, 1981** |
| Appl. No.: | **887,587** |
| Filed: | **Mar. 17, 1978** |

[30] Foreign Application Priority Data

Apr. 1, 1977 [DE] Fed. Rep. of Germany ..... 2714607

[51] Int. Cl.[3] ..... D04B 35/04
[52] U.S. Cl. ..... 66/121
[58] Field of Search ..... 66/121, 122

[56] References Cited

U.S. PATENT DOCUMENTS

| | | | |
|---|---|---|---|
| 415,310 | 11/1889 | Merrow | 66/121 |
| 541,106 | 6/1895 | Merrow et al. . | |
| 757,378 | 4/1904 | Woodward | 66/121 |
| 1,681,512 | 8/1928 | Beyer | 66/121 |
| 1,842,548 | 1/1932 | Hancock . | |
| 3,031,867 | 5/1962 | Wiederhut et al. | 66/121 |
| 4,099,391 | 7/1978 | Fukuhara . | |

FOREIGN PATENT DOCUMENTS

| | | |
|---|---|---|
| 3335908 | 10/1983 | Fed. Rep. of Germany . |
| 53-122457 | 9/1978 | Japan . |
| 54-101962 | 8/1979 | Japan . |
| 59-66553 | 4/1984 | Japan . |

*Primary Examiner*—Werner H. Schroeder
*Assistant Examiner*—Andrew M. Falik

[57] ABSTRACT

A latch needle for knitting machines has a hook and needle shank and a latch pivotally mounted in a longitudinal slot in the needle shank with the faces of the needle shank flanking the longitudinal slot having support portions recessed relative to the upper edge of the needle shank for supporting a widened portion of the rear part or spine of the latch. A short portion of the longitudinal slot contains an aperture leading to the lower edge of the needle shank, and a further portion of the longitudinal slot adjacent to the short portion is deeper than half the height of the needle shank and projects in length beyond the end of the latch in its rearward open position displaced away from the hook. The support portions of the shank for the widened portion of the spine of the latch are located over the inner starting region of the further portion of the longitudinal slot.

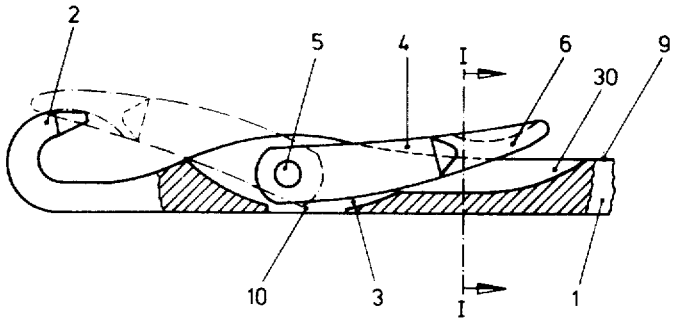

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claim 1 is confirmed.

* * * * *